US010562081B2

(12) United States Patent
Nelson

(10) Patent No.: US 10,562,081 B2
(45) Date of Patent: Feb. 18, 2020

(54) COUNTER-ROTATIONAL DUAL WHIP-HEAD DEVICE FOR FRAGMENTING SOLIDIFIED BULK MATERIALS IN CONTAINMENT VESSELS

(71) Applicant: Pneumat Systems, Inc., Mankato, MN (US)

(72) Inventor: Gregory Wallace Nelson, Mankato, MN (US)

( * ) Notice: Subject to any disclaimer, the term of this patent is extended or adjusted under 35 U.S.C. 154(b) by 800 days.

(21) Appl. No.: 15/169,152

(22) Filed: May 31, 2016

(65) Prior Publication Data

US 2017/0100754 A1 Apr. 13, 2017

Related U.S. Application Data

(60) Provisional application No. 62/238,825, filed on Oct. 8, 2015.

(51) Int. Cl.

| | |
|---|---|
| ***B08B 9/087*** | (2006.01) |
| ***B02C 13/28*** | (2006.01) |
| ***B02C 13/30*** | (2006.01) |
| ***B08B 7/02*** | (2006.01) |

(52) U.S. Cl.

CPC ..... *B08B 9/087* (2013.01); *B02C 13/28* (2013.01); *B02C 13/2804* (2013.01); *B02C 13/30* (2013.01); *B08B 7/02* (2013.01); *B02C 2013/2812* (2013.01); *B02C 2013/2816* (2013.01)

(58) Field of Classification Search

CPC .... B02C 2013/2816; B02C 2013/2812; B02C 13/30; B02C 13/2804; B02C 13/28

USPC ..... 241/193, 195, 196, 166; 475/9, 150

See application file for complete search history.

(56) References Cited

U.S. PATENT DOCUMENTS

| | | | | |
|---|---|---|---|---|
| 2,320,391 A * | 6/1943 | Wakefield | F02C 5/12 415/117 |
| 3,000,411 A * | 9/1961 | Ealet | B27L 11/002 144/176 |
| 4,451,004 A * | 5/1984 | Ostergren | A01C 3/063 239/658 |
| 4,875,630 A * | 10/1989 | Carlson | A01D 51/00 241/56 |

(Continued)

OTHER PUBLICATIONS

Skip Richter, Grass Clippings are Fertilizer, https://www.youtube.com/watch?v=j3y4DoCXQVE.*

*Primary Examiner* — Adam J Eiseman
*Assistant Examiner* — Bobby Yeonjin Kim
(74) *Attorney, Agent, or Firm* — Jeffrey C. Brown

(57) ABSTRACT

A device to fragment solidified bulk material is disclosed. The device comprises a hydraulic motor, a stationary assembly and rotating assemblies, wherein the rotating assemblies includes, a rotational upper whip mount assembly adapted to rotate in a direction, a rotational middle assembly perimeter adapted to rotate in the same direction as the rotational upper whip mount assembly, and a rotational lower whip mount assembly adapted to rotate in a direction opposite the rotational direction of the upper whip mount and middle perimeter assemblies, and a plurality of flails configured to fracture hardened, solidified bulk material while balancing the torque forces to more accurately keep the dual whip-head head in a desired location when operationally engaged with the bulk material.

10 Claims, 5 Drawing Sheets

(56) References Cited

U.S. PATENT DOCUMENTS

| | | | | |
|---|---|---|---|---|
| 5,096,262 | A * | 3/1992 | Foullois | B08B 9/051 15/104.069 |
| 6,305,623 | B1 * | 10/2001 | Sotsky | B02C 18/145 241/243 |
| 7,070,133 | B1 | 7/2006 | Harlow | |
| 7,669,793 | B2 * | 3/2010 | So | A47J 43/044 241/169.1 |
| 8,888,028 | B2 * | 11/2014 | Tulipani | A01G 20/47 241/55 |
| 9,003,754 | B1 * | 4/2015 | Fogle, III | A01D 34/005 56/295 |
| 9,849,459 | B2 * | 12/2017 | Faure | B02C 13/095 |

* cited by examiner

COUNTER-ROTATIONAL DUAL WHIP-HEAD DEVICE FOR FRAGMENTING SOLIDIFIED BULK MATERIALS IN CONTAINMENT VESSELS

BACKGROUND OF THE INVENTION

1. Field of the Invention

The present invention relates to fragmenting solidified bulk materials to facilitate the flow and removal of such materials from containment vessels, including bins, silos, hoppers and other transport vessels.

2. Description of the Prior Art

Bulk materials left undisturbed in a containment vessel like a bin or silo tend to settle, compress, and eventually solidify into a hard, amalgamated solid that is difficult to remove from the vessel. This happens frequently at cement manufacturing plants. When such bulk material must be removed from the containment vessel, to increase its storage capacity for example, manual labor is often used to fragment and remove the material. Using picks and shovels in such an environment is time consuming and increases the potential for personal injury.

To solve this problem, the applicant invented the Bin-Whip® system, which used a pneumatically-powered cleaning head and flails that was lowered into the containment vessel to fragment the solidified material instead of using human labor. The applicant later switched to a hydraulically-powered system. While effective, both the pneumatic and hydraulic systems used a cleaning head that rotated in one direction only. But because the BinWhip® represented a vast improvement over human labor, others in the industry copied applicant's pneumatic and hydraulic unidirectional systems. Thus, the current state of fragmentation systems that employ rotating flails to fragment solidified bulk materials uses a unidirectional cleaning head configured to spin in either a clockwise or counter-clockwise direction, but not simultaneously.

Whether pneumatically or hydraulically driven, the cleaning head of such systems require a hose system to carry the pressurized fluid to a motor system, which is typically housed within or proximate the cleaning head. The reactive torque that results from the flails striking the solidified material, however, puts significant rotational forces on the hose connecting the power unit to the cleaning head. As rotational speeds increase to achieve greater striking force (i.e., increasing the rotational speed of the cleaning head and flails to increase the impact forces on the solidified material), the torque forces on the cleaning head and attached hose system also increase. Under conditions when the bulk material is resistant to fragmentation, like with cement for example, increasing the rotational speed beyond 400 RPM, for example, can cause the hose system to twist and coil back on itself, potentially damaging the hose system and increasing the risk of personal injury or property damage. Consequently, the hose system's resistance to the torque created by the rotating cleaning head and flails limits the speed and efficiency of unidirectional single head cleaning systems.

Thus, there is a need for a system that can significantly the efficiency of fragmenting hardened, solidified bulk materials to assist in their removal from containment vessels. The disclosure herein accomplishes that objective.

BRIEF SUMMARY OF THE INVENTION

The device disclosed herein is designed to facilitate the removal of hardened, solidified bulk material from containment vessels, including transport vehicles. The device is part of a system that includes a hydraulic power unit, which is operably connected to a manifold system, which in turn is operably connected to a hose system comprising a hose reel and hoses, which is attachable to a mount assembly attachable to a boom assembly including a safety anchor that is configured to stabilize the hoses. The counter-rotational dual whip-head head is attachable to the hose assembly and further comprises a stationary connection assembly to operably connect the hose system to at least one hydraulic motor, a rotational upper whip mount assembly, a middle assembly—the perimeter of which rotates in the same direction as the rotational upper whip mount assembly—and a rotational lower whip mount assembly rotating in the opposite direction of the upper whip mount and middle assemblies, wherein the dual whip-head device is configured along a vertical axis. The middle assembly further comprises a stationary inner core comprising at least one hydraulic motor and at least one in-line gearbox. The gearbox includes a set of beveled gears—an upper and lower beveled gear—which are configured in separate horizontal planes and are operationally connected to each other by a plurality of pinion gears that rotate around a horizontal axis. The hydraulic motor directly drives the upper beveled gear. This in turn causes the pinion gears to rotate about a horizontal axis 90 degrees from the vertical axis of the hydraulic motor and gearbox. When the upper beveled gear is put in rotational movement by the hydraulic motor, the pinion gears, being engaged with both the upper and lower beveled gears, transfers an opposite-direction rotational force and movement to the lower beveled gear, which in turn drives an upper drive plate and an upper whip mount assembly in a rotational direction opposite the upper beveled gear. The pinion gears are fixed into position in the body of the gearbox so they supply rotation transfer only between the upper and lower beveled gears. The lower beveled gear drives the upper drive plate, the perimeter of the middle assembly, and the upper whip mount assembly in a rotational movement opposite the rotational movement of the lower whip mount assembly and the upper beveled gear.

Two concentric shafts extend out the bottom of the gearbox. The first shaft is an inner solid shaft that is operably connected to the upper beveled gear. The second shaft is a hollow shaft that is operably connected to the lower beveled gear and rotates in the opposite direction around the inner shaft. A set of needle bearings separates the counter-rotating shafts to minimize any friction between them as they rotate. A keyless coupler is attachable on the outer shaft and is operably connected to an upper drive plate, which in turn is operably connected to a plurality of stand-off rods mounted on the upper drive plate that rotate around the outside of the gearbox and hydraulic motor and that connect to and drive the rotating perimeter of the middle and upper whip mount assemblies of the dual whip-head.

A stationary connection assembly (shown in FIG. 1 at 102, 107-109, and 111-113) serves as the junction for the hydraulic supply and return lines that connect the hydraulic motor on one side and the hydraulic hoses on the other side.

First, the counter-rotational configuration of the dual whip-head balances the torque forces on the hydraulic hose, which allows greater rotational speeds and keeps the dual whip-head in place and prevents it from 'walking' across the surface of the bulk material in response to frictional forces between the rotating perimeter of the middle assembly and/or flails and the bulk material. This balancing of torque forces allows for more precise positioning of the dual whip-head. The use of counter-rotational dual whip-heads essentially doubles the fragmentation power of the system. The counter-rotational configuration of the instant disclosure also allows for fragmentation of stratified layers and ledges of bulk material that single-head systems find challenging because of the single operational plane of single-head systems.

DESCRIPTION OF THE DRAWINGS

The invention can be better understood by reference to the following drawings, wherein.

DETAILED DESCRIPTION

In the following detailed description, reference is made to the accompanying drawings that form a part hereof, and in which are shown by way of illustration specific embodiments or examples. These embodiments may be combined, other embodiments may be utilized, and structural, logical, and procedural changes may be made without departing from the spirit and scope of the present invention. The following detailed description is, therefore, not to be taken in a limiting sense, and the scope of the present invention is defined by the appended claims and their equivalents.

Figure 1:
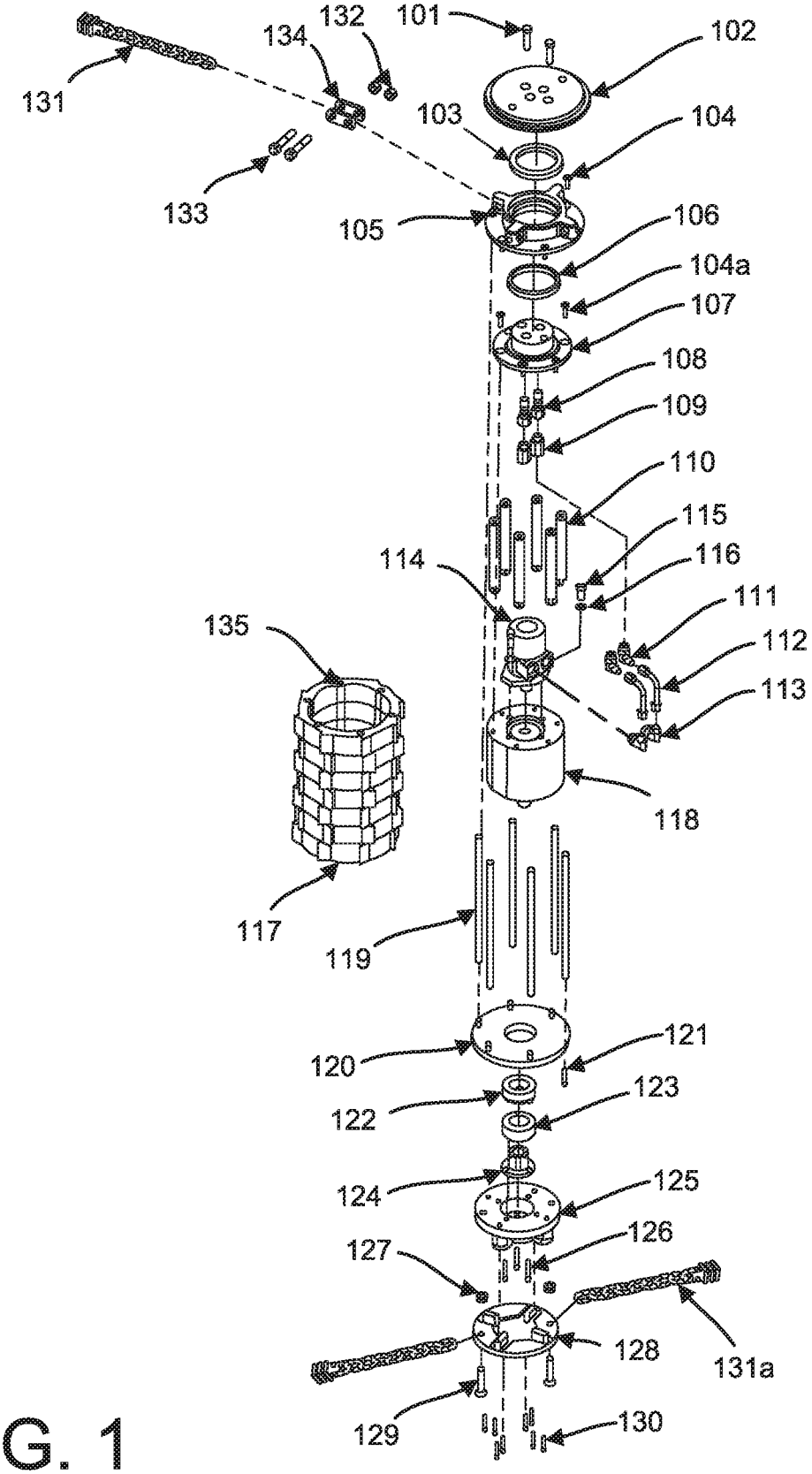
FIG. 1 is an exploded view of an embodiment of the counter-rotational dual whip-head for fragmenting solidified bulk materials in containment vessels.
Figure 2:
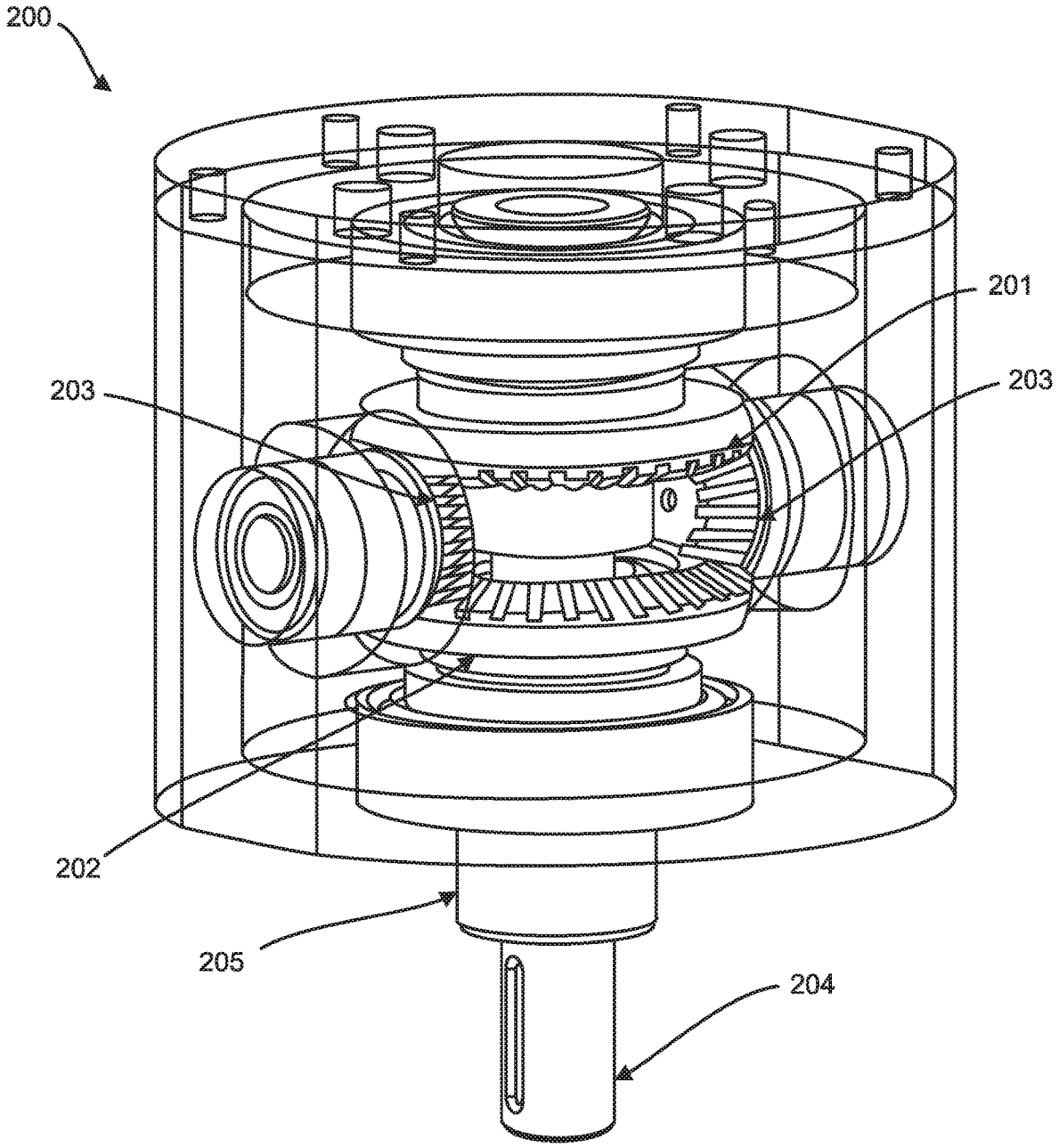
FIG. 2 is a transparent view of an embodiment of a gearbox of the counter-rotational dual whip-head for fragmenting solidified bulk materials in containment vessels.

As disclosed in FIG. 1, an embodiment of a counter-rotational whip head includes at least two bolts 101 that secure a stationary upper receiver 102 to a stationary lower receiver 107. Straddling a rotating upper whip mount 105 are a seal 103 and a radial bearing 106 that allow the upper whip mount 105 to rotate under the power transferred by a hydraulically-powered gearbox 118 to a plurality of rotating drive stand-off rods 119 that are operably connected to the upper whip mount 105 by a plurality of bolts 104. Flails 131 are attachable to the upper whip mount 105 via a plurality of adapter clevis's 134. The flails 131 are secured to the adapter clevis's 134 by a plurality of nuts 132 and bolts 133.

The plurality of rotating drive stand-off rods 119 are further secured to an upper drive plate 120 with a plurality of bolts 121. A plurality of fragmentation collars 117 may be secured to the stand-off rods 119. The combined structure of these components serve to stabilize and unify the rotating middle section 502 of the whip head 501. When the plurality of fragmentation collars 117 are secured between the upper whip mount 107 and the upper drive plate 120 by stacking the fragmentation collars 117 over the stand-off rods 119, they comprise a rotating perimeter of the middle assembly.

A plurality of bolts 104*a* also connect the stationary lower receiver 107 to the housing of the hydraulically-powered gearbox 118 via a plurality of shorter length stand-off rods 110. Pressurized hydraulic fluid is transferred into and out of the hydraulic motor 114, through a hydraulic fluid conduit system comprising a plurality of hydraulic flush fittings 108, which are connectable to a pressurized hydraulic fluid source, a plurality of hydraulic adapters 109, a plurality of upper elbow fittings 111, a plurality of hydraulic pipes 112, and a plurality of lower elbow fittings 113. The lower elbow fittings 113 are, in turn, directly connected to the hydraulic motor 114. The hydraulic motor 114 is secured to the gearbox case 200 with a plurality of bolts 115 and lock washers 116. The hydraulic motor 114, when put in rotational movement by the flow of the pressurized hydraulic fluid, transfers a rotational force to an encased gearbox 118 200. The bolts 104*a*, radial bearing 106, stationary lower receiver 107, hydraulic flush fittings 108, hydraulic adapters 109, shorter length stand-off rods 110, upper elbow fittings 111, hydraulic pipes 112, lower elbow fittings 113, hydraulic motor 114, bolts 115 and lock washers 116, and encased gearbox 118 comprise a stationary, middle assembly.

As disclosed in Hg. 2, the encased gearbox 200 includes a set of beveled gears 201 202 configured in separate horizontal planes that are operably connected to each other by a plurality of pinion gears 203 that rotate around a horizontal axis. Engaging the hydraulic motor causes the upper bevel gear 201 to rotate on its vertical axis, which in turn causes the pinion gears 203 to rotate about a horizontal axis about 90 degrees from the vertical axis of the motor 114 and gearbox 200. When the upper beveled gear 201 is put in rotational movement by the hydraulic motor 114, the pinion gears 203, being operably engaged with both the upper 201 and lower 202 beveled gear sets, transfers an opposite-direction rotational force and movement to the lower beveled 202 gear set. The upper beveled gear set 201 drives an inner solid shaft 204 that drives the lower whip mount 125. The lower beveled gear set 202, being in opposite rotational direction to the upper beveled gear 201, drives an outer hollow shaft 205 that drives the rotational perimeter of the middle assembly 502 and the upper whip mount 105 in a rotational direction opposite the lower whip mount 125.

By way of non-limiting example only, if pressurized hydraulic fluid is introduced into the hydraulic motor 114 so that the motor 114 rotates in a counter-clockwise direction, that rotational movement is directly transferred to the upper beveled gear 201 and the inner solid shaft 204 that ultimately drives the lower whip mount 125 in the same counter-clockwise direction. Accordingly, the upper beveled gear 201, being engaged with the pinion gears 203, causes the lower beveled gear 202 and outer hollow shaft 205 to rotate in a clockwise direction. The upper drive plate 120 is connected to a keyless coupler 122 that in turn is operably connected to the outer hollow shaft 205. Thus, as the outer hollow shaft 205 rotates in a clockwise direction, that rotational movement is transferred from the keyless coupler 122 to the upper drive plate 120 and the rotating drive stand-off rods 119 to rotate the perimeter of the middle assembly 502 and upper whip mount 105 in the same clockwise direction. The seal 103, bolts, 104, upper whip mount 105, stand-off rods 119, upper drive plate 120, bolts 121, and keyless coupler 122 comprise an upper whip mount assembly.

Positioned between the rotating upper drive plate 120 and the lower whip mount 125 are a hub for a taper-lock bushing 123, and a 1-inch taper lock bushing 124 that are configured to allow the lower whip mount 125 to rotate in the same direction as the inner shaft. The lower whip mount 125 is connected to a whip mount cover 128 with a plurality of pinions 126 and bolts 130. A plurality of flails 131*a* may be secured between the lower whip mount 125 and the whip mount cover 128 with a plurality of nuts 127 and bolts 129. The taper-lock bushing hub 123, 1-inch taper lock bushing 124, lower whip mount 125, pinions 126 and bolts 130, nuts 127 and bolts 129, and whip mount cover 128 comprise a lower whip mount assembly.

Figure 3:
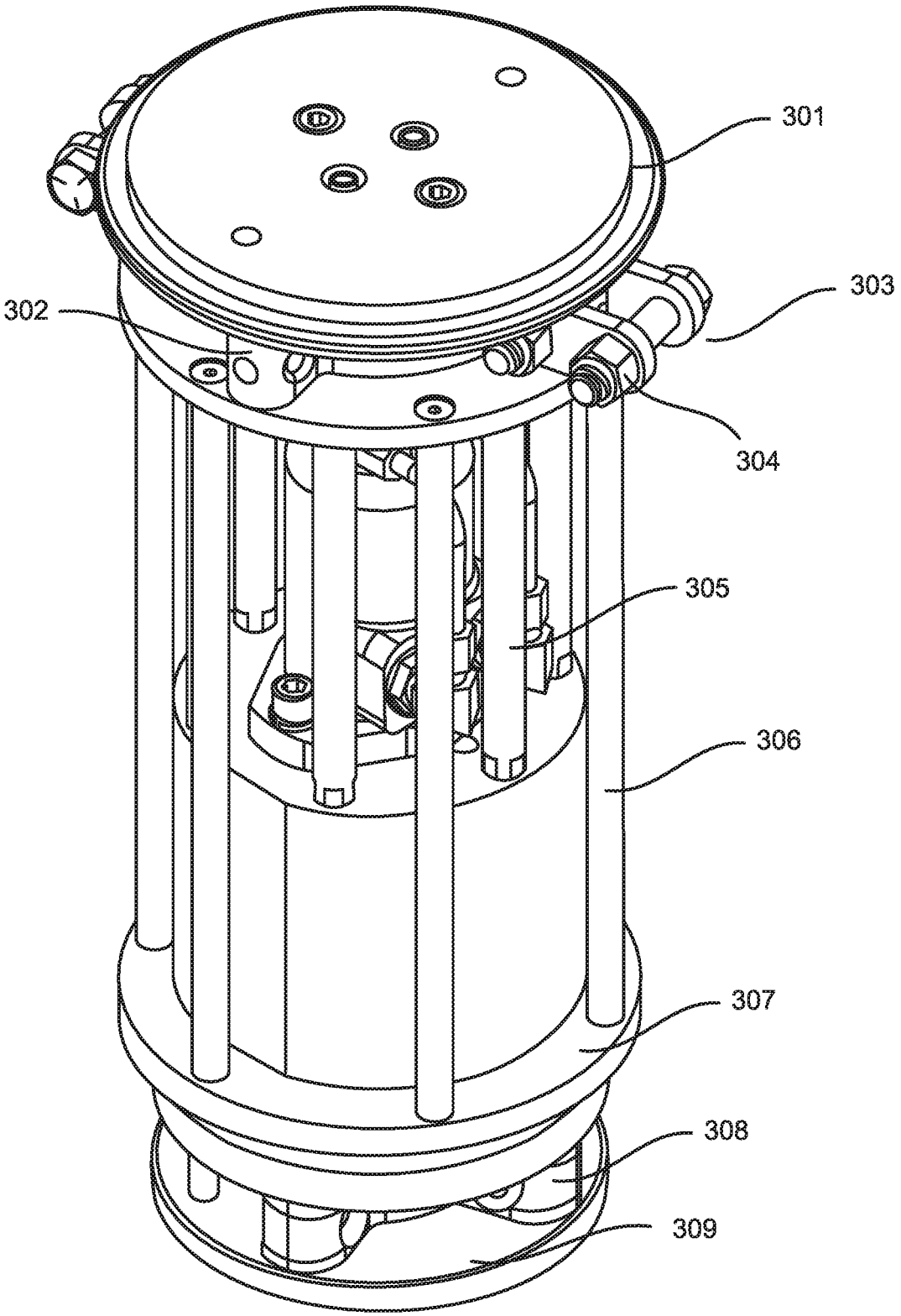
FIG. 3 is a perspective view of a partially assembled counter-rotational dual whip-head for fragmenting solidified bulk materials in containment vessels.

FIG. 3 discloses the major components of the counter-rotational whip head, including the upper receiver 301, the upper whip mount 302, and the clevis assembly 303, including its nuts and bolts 304 for attaching the flails 131 to the upper whip mount 302. FIG. 3 further discloses the shorter length stand-off rods 305, the rotating drive stand-off rods 306, the upper drive plate 307, and the combined lower whip mount 308 and whip mount cover 309.

Figure 4:
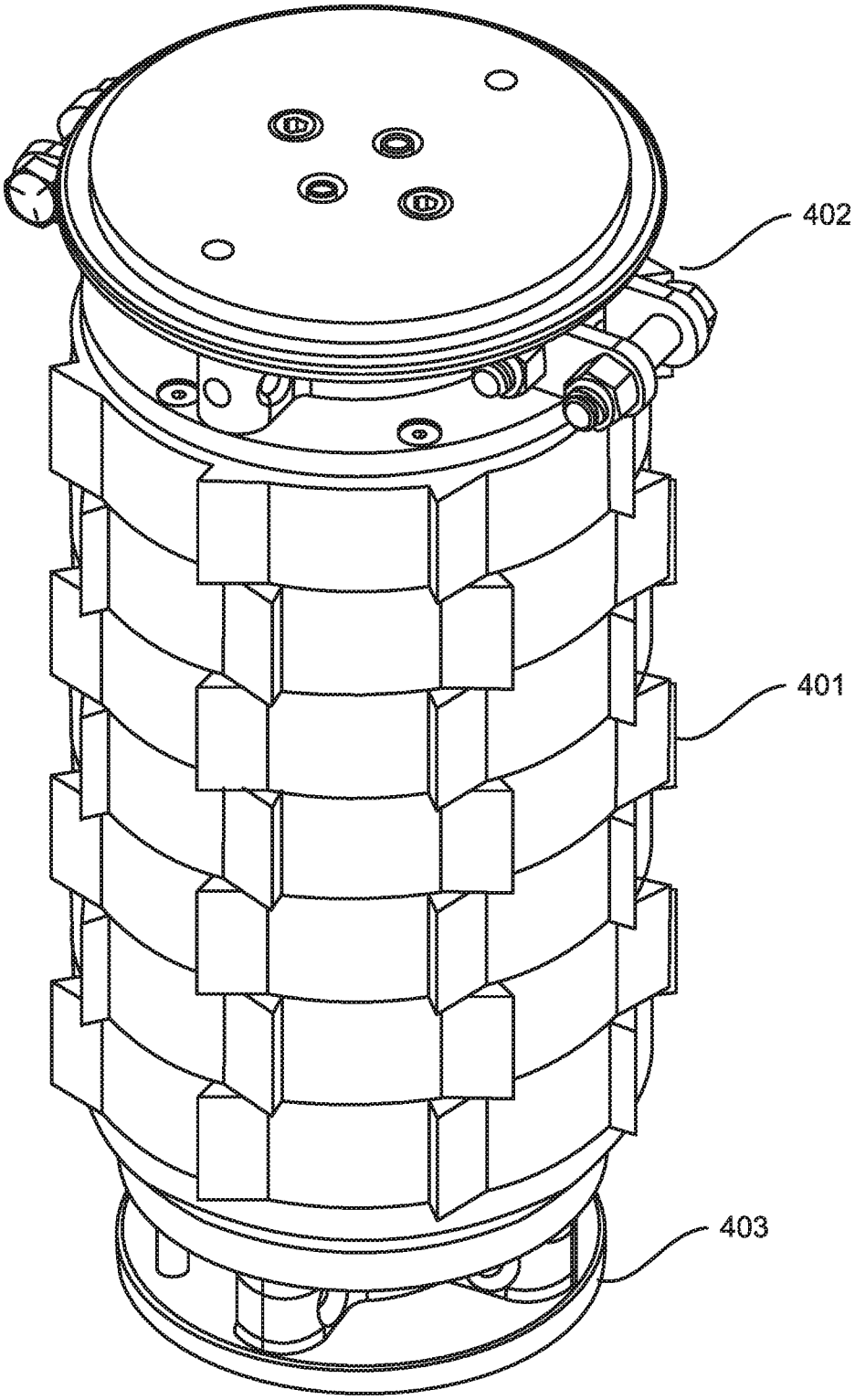
FIG. 4 is a perspective view of a partially assembled counter-rotational dual whip-head for fragmenting solidified bulk materials in containment vessels.

FIG. 4 discloses an embodiment that includes a middle assembly comprising a plurality of saw-toothed, fragmentation collars 117 401. In this embodiment, the saw-toothed fragmentation collars 117 401 are stacked between the upper drive plate 120 307 and the upper whip mount 105. 302 and include a plurality of holes 135 that correspond to the number and spacing of each rotating drive stand-off rod 119 306. The fragmentation collars 117 401 are stacked, one on top of the other, by passing the holes in the collars 135 over the rotating drive stand-off rods 119 306 until the collars 117 401 are stacked securely between the upper drive plate 120. 307 and the upper whip mount 105 302. In such an embodiment, the saw-toothed fragmentation collars 117 401, which are rotating in the same direction and speed as the upper whip mount 105 302, provide an increased fragmentation surface that may be applied against the solidified material along with the flails 131 131*a*.

Figure 5:
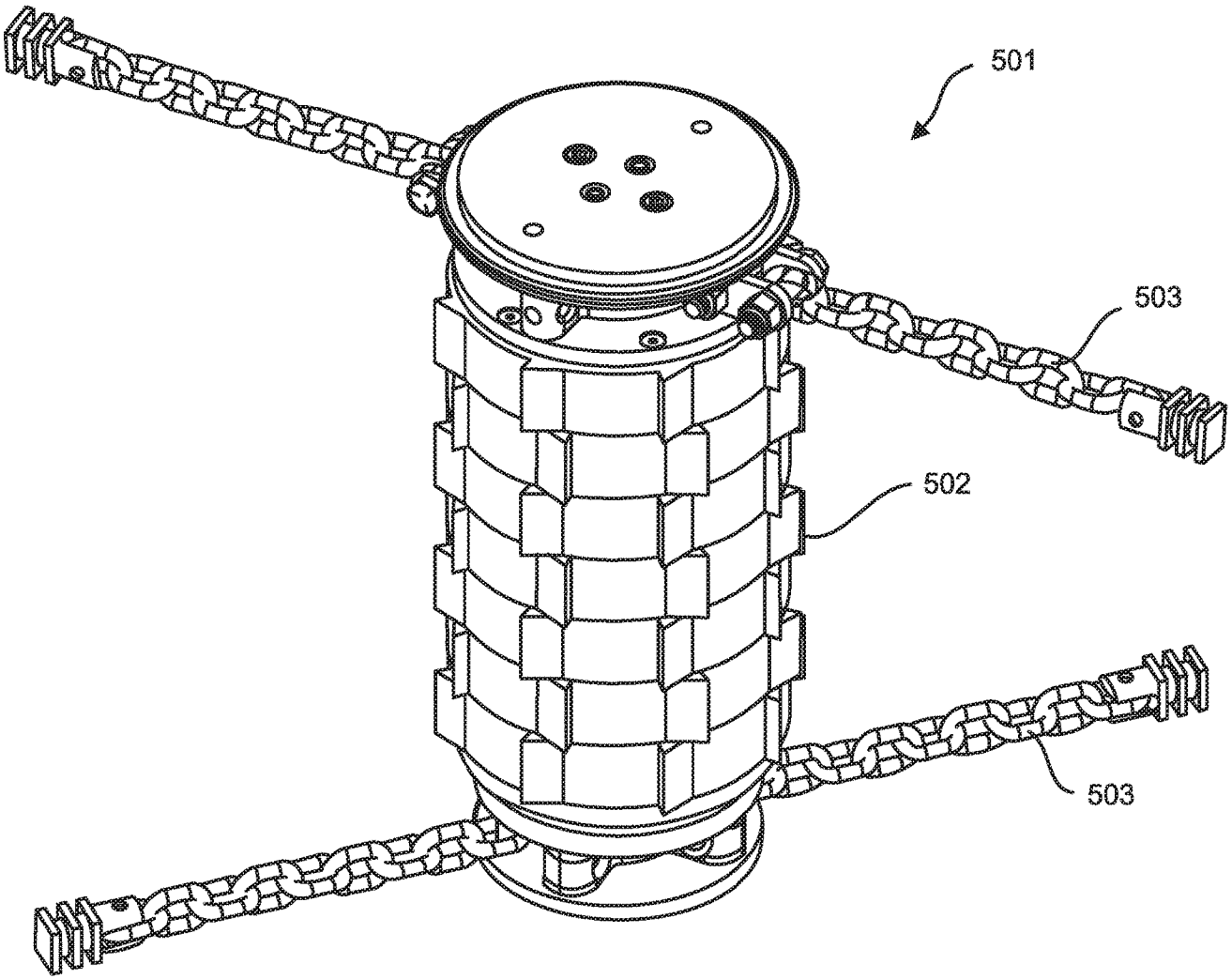
FIG. 5 is a perspective view of a fully assembled counter-rotational dual whip-head for fragmenting solidified bulk materials in containment vessels.

FIG. 5 discloses a completely assembled counter-rotational dual whip-head embodiment 501 that includes saw-toothed, fragmentation collars 502 chain link flails 503 on both upper and lower whip mounts.

It is to be understood that the above description is intended to be illustrative and not restrictive. For example, the above-described embodiments and variations may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A device to fragment solidified bulk material comprising:

a. a hydraulic motor;

b. a stationary middle assembly and rotating assemblies, wherein the rotating assemblies include an upper whip mount assembly adapted to rotate in a direction, a rotating perimeter of the stationary middle assembly adapted to rotate in the same direction as the rotational upper whip mount assembly, and a lower whip mount assembly adapted to rotate in a direction opposite the rotational direction of the upper whip mount assembly and the rotating perimeter of the stationary middle assembly; and c. a plurality of flails.

2. The device of claim 1, wherein the stationary middle assembly includes an upper receiver, a lower receiver, a radial bearing, a hydraulic fluid conduit assembly, the hydraulic motor, an encased gearbox assembly, and a plurality of stationary stand-off rods.

3. The device of claim 2, wherein the encased gearbox includes, a set of upper and lower beveled gears, a plurality of pinion gears, an inner solid shaft, and an outer hollow shaft.

4. The device of claim 3, wherein the set of upper and lower beveled gears are configured in separate horizontal planes and are operationally connected to each other by the plurality of pinion gears that are configured to rotate around a horizontal axis, which said horizontal axis is about 90 degrees from the vertical axis of the hydraulic motor and the encased gearbox, and wherein the upper beveled gear drives the inner solid shaft that drives the lower whip mount assembly, and the lower beveled gear, being in opposite rotational direction to the upper beveled gear, drives the outer hollow shaft that drives the rotational perimeter of the middle and upper whip mount assemblies.

5. The device of claim 2, wherein the hydraulic fluid conduit assembly includes a plurality of hydraulic flush fittings, a plurality of hydraulic adapters, a plurality of upper elbow fittings, a plurality of hydraulic pipes, and a plurality of lower elbow fittings.

6. The device of claim 1, wherein the rotational upper whip mount assembly includes a seal, and an upper whip mount.

7. The device of claim 1, wherein the rotational middle assembly includes a keyless coupler, an upper drive plate, and a plurality of rotating drive stand-off rods.

8. A device to fragment solidified bulk material comprising:

a. a hydraulic motor;

b. a stationary middle assembly and rotating assemblies, wherein the stationary middle assembly further comprises a connection assembly, and wherein the rotating assemblies include an upper whip mount assembly adapted to rotate in a direction, a rotating perimeter of the stationary middle assembly adapted to rotate in the same direction as the rotational upper whip mount assembly, and a lower whip mount assembly adapted to rotate in a direction opposite the rotational direction of the upper whip mount assembly and the rotating perimeter of the stationary middle assembly; and c. a plurality of fragmentation collars mounted on the rotating perimeter of the stationary middle assembly.

9. The device of claim 1, wherein the plurality of flails include materials selected from the group consisting of steel whips, chain-link, and hardened plastic.

10. The device of claim 8, wherein the plurality of fragmentation collars include saw-toothed, fragmentation collars.

* * * * *